US009105183B2

(12) United States Patent
Samuthirapandian et al.

(10) Patent No.: US 9,105,183 B2
(45) Date of Patent: Aug. 11, 2015

(54) SYSTEM AND METHOD FOR GRAPHICALLY DISPLAYING AIRCRAFT TRAFFIC INFORMATION USING AIRCRAFT SYMBOLOGY

(71) Applicant: HONEYWELL INTERNATIONAL INC., Morristown, NJ (US)

(72) Inventors: Subash Samuthirapandian, Tamilnadu (IN); Markus Alan Johnson, Blue River, OR (US); Ronald Brian Wayman, Auburn, WA (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 198 days.

(21) Appl. No.: 13/919,572

(22) Filed: Jun. 17, 2013

(65) Prior Publication Data

US 2014/0368356 A1 Dec. 18, 2014

(51) Int. Cl.
*G08B 21/00* (2006.01)
*G08G 5/00* (2006.01)

(52) U.S. Cl.
CPC ..... *G08G 5/0004* (2013.01); *G08G 5/0021* (2013.01); *G08G 5/0013* (2013.01)

(58) Field of Classification Search
USPC ..... 340/901, 945, 961, 963, 971, 973; 701/120, 301; 342/36, 38
See application file for complete search history.

(56) References Cited

U.S. PATENT DOCUMENTS

| | | | | |
|---|---|---|---|---|
| 6,348,877 | B1 | 2/2002 | Berstis et al. | |
| 7,570,178 | B1 * | 8/2009 | Whalen et al. | 340/961 |
| 7,965,223 | B1 * | 6/2011 | McCusker | 342/29 |
| 8,314,719 | B2 | 11/2012 | Grothe | |
| 8,626,428 | B2 | 1/2014 | Ramaiah et al. | |
| 2009/0118998 | A1 | 5/2009 | Chau et al. | |
| 2009/0171899 | A1 | 7/2009 | Chittoor et al. | |
| 2011/0006918 | A1 | 1/2011 | Shafaat et al. | |
| 2011/0187588 | A1 | 8/2011 | Khatwa et al. | |
| 2011/0270715 | A1 | 11/2011 | Moorhead | |
| 2012/0182161 | A1 | 7/2012 | Rutherford et al. | |
| 2013/0027226 | A1 | 1/2013 | Cabos | |
| 2013/0093612 | A1 | 4/2013 | Pschierer et al. | |

OTHER PUBLICATIONS

EP Extended Search Report for Application No. EP 14171219.0 dated Jan. 27, 2015.

Kostal, E.; NOTAM Visualization Graphical NOTAMs Finally a Reality; http://aeronavdata.com/wp-content/uploads/2013/09/KORD-Selected-Screen-Shot.jpg.

* cited by examiner

*Primary Examiner* — Jeffery Hofsass
(74) *Attorney, Agent, or Firm* — Ingrassia Fisher & Lorenz, P.C.

(57) ABSTRACT

Presented herein is a system and method for graphically displaying aircraft traffic information. The system comprises an Operating Company Symbology database and a display system coupled to a processor that is configured to (1) receive traffic information; (2) determine the Operating Company Symbology from the received traffic information; (3) receive a selection of an aircraft or traffic information including at least one of the Flight ID, Operating Company, or Surface Traffic; (4) graphically render aircraft symbology and the associated traffic information on the display.

19 Claims, 7 Drawing Sheets

SYSTEM AND METHOD FOR GRAPHICALLY DISPLAYING AIRCRAFT TRAFFIC INFORMATION USING AIRCRAFT SYMBOLOGY

TECHNICAL FIELD

Embodiments of the subject matter described herein relate generally to avionics display systems. More particularly, embodiments of the subject matter described herein relate to a system and method for graphically displaying aircraft traffic information.

BACKGROUND

Air traffic control (ATC) regulates and monitors traffic around airports in order to efficiently control the ingress and egress of aircraft. In doing so, ATC may request that a pilot locate other aircraft by providing the pilot with their flight identification (ID), aircraft type, and/or operating company. A sample dialog between ATC and an aircraft (e.g. Gulfstream XYZ) might be . . . ATC: "Gulfstream XYZ, you are number three for the airport; traffic is a Southwest Boeing 737 at your 2 o'clock and 6 miles. Plan to follow him, report that traffic in sight." Gulfstream XYZ: "Roger, looking for the traffic."

This requires the pilot of Gulfstream XYZ to look out the window and find the Southwest aircraft. To aid the pilot in this task, ATC has provided the pilot with information regarding the position of the Southwest aircraft, "at 2 o'clock and 6 miles". However, this method of locating the aircraft is inefficient and burdensome. The problem is exacerbated by the host aircraft's own movement and pilot fatigue, etc. To assist pilots with the task of identifying other aircraft, many aircraft are equipped with an avionics display system that graphically renders a moving map including a depiction of the neighboring aircraft. This assists the pilot of the host aircraft to visualize all aircraft surrounding the host aircraft and helps the pilot determine the appropriate time to look out the window and the direction of the neighboring aircraft. ATC may provide the pilot with the aircraft type and/or operating company; however, this information is not displayed on the map.

In view of the forgoing, it would be desirable to provide a system and method for graphically displaying aircraft traffic information that includes at least one of the flight ID, aircraft type, and operating company.

BRIEF SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

A method is provided for graphically displaying traffic information. The method comprises receiving traffic information and graphically rendering aircraft symbology representative of at least one aircraft. The user selects traffic information including at least one of the Flight ID, Operating Company, or Surface Traffic. Graphical representations are rendered of the selected traffic information associated with the rendered aircraft symbology.

Also provided is a method for graphically displaying traffic information associated with an aircraft. The method comprises receiving traffic information and graphically rendering at least one aircraft within a display radius. The user selects an aircraft symbology and the associated Flight ID and/or Operating Company Symbology are graphically rendered on the display.

Furthermore, a system for graphically displaying flight information is provided. The system comprises an Operating Company Symbology database and a display system coupled to a processor that is configured to (1) receive traffic information; (2) determine the Operating Company Symbology from the received traffic information; (3) graphically render aircraft symbology and the associated Operating Company Symbology.

DETAILED DESCRIPTION

The following detailed description is merely exemplary in nature and is not intended to limit the subject matter of the application and uses thereof. Furthermore, there is no intention to be bound by any theory presented in the preceding background or the following detailed description. Presented herein for purposes of explication are a certain exemplary embodiments of how traffic information, particularly Flight ID and Operating Company Symbology may be graphically displayed in a readily comprehendible manner. It should be appreciated that these explicated example embodiments are merely examples and guides for implementing the novel display system and method for graphically displaying traffic information symbology. As such, the examples presented herein are intended as non-limiting.

Techniques and technologies may be described herein in terms of functional and/or logical block components and with reference to symbolic representations of operations, processing tasks, and functions that may be performed by various computing components or devices. It should be appreciated that any number of hardware, software, and/or firmware components configured to perform the specified functions may realize the various block components shown in the figures. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

The following description may refer to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements, additional intervening elements, devices, features, or components may be present in an embodiment of the depicted subject matter. In addition, certain terminology may also be used in the following description for the purpose of reference only, and thus are not intended to be limiting.

For the sake of brevity, conventional techniques related to graphics and image processing, navigation, flight planning, aircraft controls, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Figure 1:
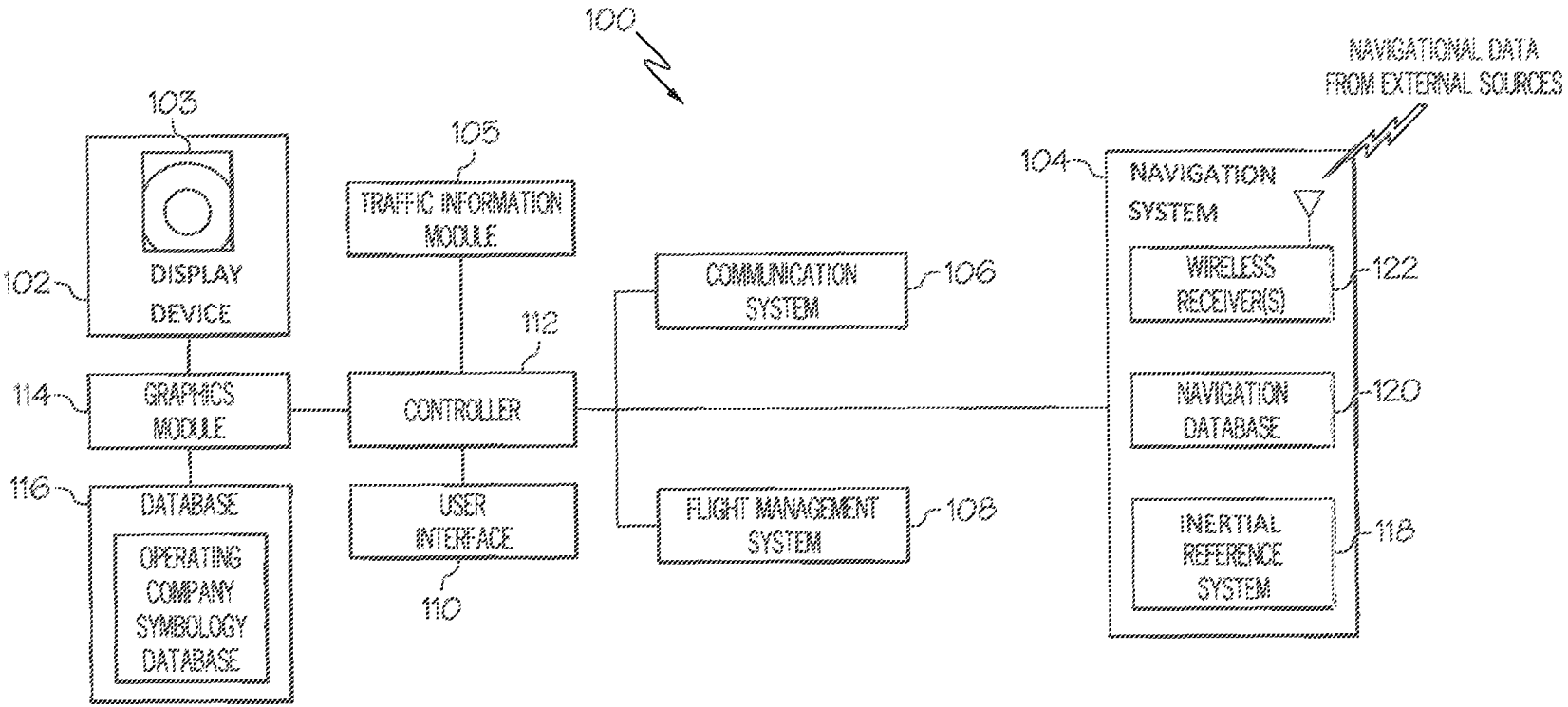
FIG. 1 is a block diagram of an information display system suitable for use in an aircraft in accordance with an embodiment.

FIG. 1 depicts an exemplary embodiment of an aircraft display system 100. In an exemplary embodiment, the display system 100 includes, without limitation, a display device 102 for displaying a graphical flight plan image 200, a navigation system 104, a traffic information module 105, a communications system 106, a flight management system (FMS) 108, a controller 112, a graphics module 114, a user interface 110, and a database 116 including an operating company symbology database, suitably configured to support operation of the graphics module 114 and display device 102, as described in greater detail below. Navigation system 104 may include an inertial reference system 118, a navigation database 120 and one or more wireless receivers 122 for receiving navigational data from external sources in a well-known manner.

It should be understood that FIG. 1 is a simplified representation of a display system 100 for purposes of explanation and ease of description and is not intended to limit the application or scope of the subject matter in any way. In practice, the display system 100 and/or the aircraft will include numerous other devices and components for providing additional functions and features, as will be appreciated in the art. For example, the display system 100 and/or the aircraft may include one or more avionics systems (e.g., an air traffic management system, a radar system, a traffic avoidance system) coupled to the flight management system 108 and/or the controller 112 for obtaining and/or providing real-time flight-related information that may be displayed on the display device 102.

In an exemplary embodiment, display device 102 is coupled to the graphics module 114. The graphics module 114 is coupled to the controller 112. Controller 112 and the graphics module 114 are cooperatively configured to display, render, or otherwise convey graphical representations or images of traffic information symbols on the display device 102. As stated previously, navigational system 104 includes an inertial reference system 118, a navigation database 120, and at least one wireless receiver 122. Inertial reference system 118 and wireless receiver 122 provide controller 112 with navigational information derived from sources onboard and external to the host aircraft, respectively. More specifically, inertial reference system 118 provides controller 112 with information describing various flight parameters of the host aircraft (e.g., position, orientation, velocity, etc.) as monitored by a number of motion sensors (e.g., accelerometers, gyroscopes, etc.) deployed onboard the aircraft. By comparison, and as indicated in FIG. 1, wireless receiver 122 receives navigational information from various sources external to the aircraft. These sources may include various types of navigational aids (e.g., global position systems, non-directional radio beacons, very high frequency omni-directional radio range devices (VORs), etc.), ground-based navigational facilities (e.g., Air Traffic Control Centers, Terminal Radar Approach Control Facilities, Flight Service Stations, and control towers), and ground-based guidance systems (e.g., instrument landing systems). In certain instances, wireless receiver 122 may also periodically receive Automatic Dependent Surveillance-Broadcast (ADS-B) data from neighboring aircraft. In a specific implementation, wireless receiver 122 assumes the form of a multi-mode receiver (MMR) having global navigational satellite system capabilities. The ADS-B data is received by the traffic information module 105, this data then is parsed into individual parts. These parts are then utilized to determine the operating company information for each aircraft. The operating company information and symbology is stored in database 116 and must be retrieved in relevant part based on the selection of the pilot. In addition, other traffic information, such as, Flight ID, location, bearing, altitude, are determined from the other parts of the ADS-B data and is displayed in response to the pilot selecting these data types.

Navigation database 120 includes various types of navigation-related data stored therein. In a preferred embodiment, navigation database 120 is an onboard database that is carried by the aircraft. The navigation-related data includes various flight plan related data such as, for example, and without limitation: locational data for geographical waypoints; distances between waypoints; track between waypoints; data related to different airports; navigational aids; obstructions; special use airspace; political boundaries; communication frequencies; and aircraft approach information. The navigation system 104 is also configured to obtain one or more navigational parameters associated with operation of the aircraft. The navigation system 104 may be realized as a global positioning system (GPS), inertial reference system (IRS), or a radio-based navigation system (e.g., VHF Omni-directional radio range (VOR) or long range aid to navigation (LORAN)), and may include one or more navigational radios or other sensors suitably configured to support operation of the navigation system 104, as will be appreciated in the art. In an exemplary embodiment, the navigation system 104 is capable of obtaining and/or determining the instantaneous position of the aircraft, that is, the current location of the aircraft (e.g., the latitude and longitude) and the altitude or above ground level for the aircraft. The navigation system 104 may also obtain and/or determine the heading of the aircraft (i.e., the direction the aircraft is traveling in relative to some reference).

Controller 112 is coupled to the navigation system 104 for obtaining real-time navigational data and/or information regarding operation of the aircraft to support operation of the display system 100. The communications system 106 is also coupled to the controller 112 and configured to support communications to and/or from the aircraft, as is appreciated in the art. The controller 112 is coupled to the flight management system 108, which in turn, may also be coupled to the navigation system 104 and the communications system 106 for providing real-time data and/or information regarding operation of the aircraft to the controller 112 to support operation of the aircraft. In addition, a traffic information module 105 is coupled to the controller 112, and utilizes ADS-B data gathered from the wireless receiver 122 to graphically generate symbology that represents the surrounding aircraft and their associated traffic information. Furthermore, the user interface 110 is coupled to the controller 112, and the user interface 110 and the controller 112 are cooperatively configured to allow a user to interact with display device 102 and other elements of display system 100, as described in greater detail below.

In an exemplary embodiment, the display device 102 is realized as an electronic display configured to graphically display traffic information, weather information, and/or other data associated with operation of the aircraft under control of the graphics module 114. In an exemplary embodiment, the display device 102 is located within a cockpit of the aircraft. It will be appreciated that although FIG. 1 shows a single display device 102, in practice, additional display devices may be present onboard the aircraft. The user interface 110 is also located within the cockpit of the aircraft and adapted to allow a user (e.g., pilot, co-pilot, or crew member) to interact with the remainder of display system 100 and enables a user to select content displayed on the display device 102, as described in greater detail below. In various embodiments, the user interface 110 may be realized as a keypad, touchpad, keyboard, mouse, touch screen, joystick, knob, microphone, or another suitable device adapted to receive input from a user. In preferred embodiments, user interface 110 may be a touch screen, cursor control device, joystick, or the like.

In an exemplary embodiment, the communications system 106 is suitably configured to support communications between the aircraft and another aircraft or ground location (e.g., air traffic control). In this regard, the communications system 106 may be realized using a radio communication system or another suitable data link system. In an exemplary embodiment, the flight management system 108 (or, alternatively, a flight management computer) is located onboard the aircraft. Although FIG. 1 is a simplified representation of display system 100, in practice, the flight management system 108 may be coupled to one or more additional modules or components as necessary to support navigation, flight planning, and other aircraft control functions in a conventional manner.

The controller 112 and/or graphics module 114 are configured in an exemplary embodiment to display and/or render symbology on the display device 102 that is representative of the flight information. This allows a user (e.g., via user interface 110) to gain a better understanding of the surrounding aircraft. In addition, the user can review various aspects (e.g., Operating Company, Flight ID, aircraft type, speed of the aircraft, estimated flight time, rates of ascent/descent, flight levels and/or altitudes, and the like) of the surrounding aircraft. The controller 112 generally represents the hardware, software, and/or firmware components configured to facilitate the display and/or rendering of a navigational map on the display device 102 and perform additional tasks and/or functions described in greater detail below. Depending on the embodiment, the controller 112 may be implemented or realized with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. The controller 112 may also be implemented as a combination of computing devices, e.g., a combination of a digital signal processor and a microprocessor, a plurality of microprocessors, one or more microprocessors in conjunction with a digital signal processor core, or any other such configuration. In practice, the controller 112 includes processing logic that may be configured to carry out the functions, techniques, and processing tasks associated with the operation of the display system 100, as described in greater detail below. Furthermore, the steps of a method or algorithm described in connection with the embodiments disclosed herein may be embodied directly in hardware, in firmware, in a software module executed by the controller 112, or in any practical combination thereof.

The graphics module 114 generally represents the hardware, software, and/or firmware components configured to control the display and/or rendering of a navigational map on the display device 102 and perform additional tasks and/or functions described in greater detail below. In an exemplary embodiment, the graphics module 114 accesses one or more databases 116 including Operating Company Symbology database suitably configured to support operations of the graphics module 114, as described below. In this regard, the database 116 may comprise a Operating Company Symbology database, a waypoint database, required navigation performance (RNP) database, terrain database, a weather database, a flight plan database, an obstacle database, a navigational database, a geopolitical database, a terminal airspace database, a special use airspace database, or other information for rendering and/or displaying content on the display device 102, as described below. It will be appreciated that although FIG. 1 shows a single database 116 for purposes of explanation and ease of description, in practice, numerous databases will likely be present in a practical embodiment of the display system 100.

Figure 2:
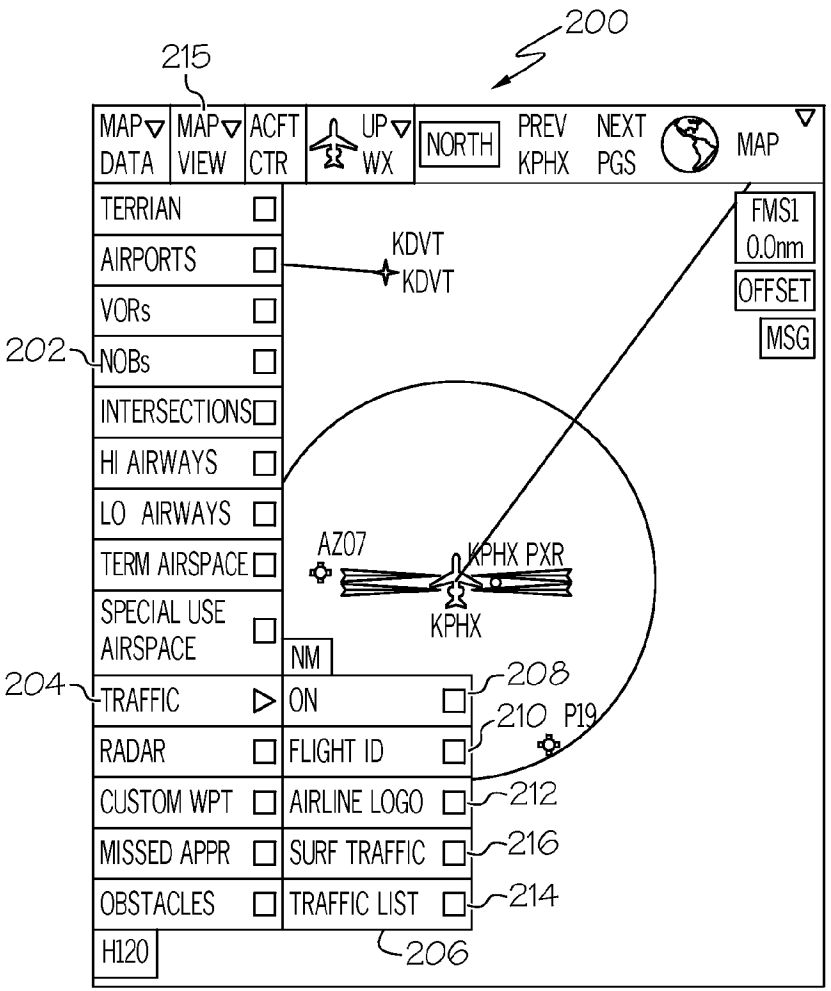

FIG. 2 is an exemplary visual display 200 that may be rendered by the aircraft display system 102 of FIG. 1. As can be seen, display 200 renders a computer generated menu system 202 along with aircraft symbology. The menu system 202 allows the pilot to display only desired information, including but not limited to terrain, airways, traffic, and etc. By only displaying desired information, the display screen will be less cluttered, thus permitting easy interpretation of the displayed data. As depicted in FIG. 2, the pilot has selected the traffic button 204, which renders a traffic menu 206. Traffic menu 206 is comprised of multiple buttons that include "ON" 208, "FLIGHT ID" 210, "AIRLINE LOGO" 212, "SURF TRAFFIC" 216, and "TRAFFIC LIST" 214. The pilot may select each of these buttons individually to render only the associated information on the screen. Alternatively, multiple buttons may be selected to display addition data if desired. However, the pilot may be required to select the ON button 208 before any button may be selected.

Figure 3:
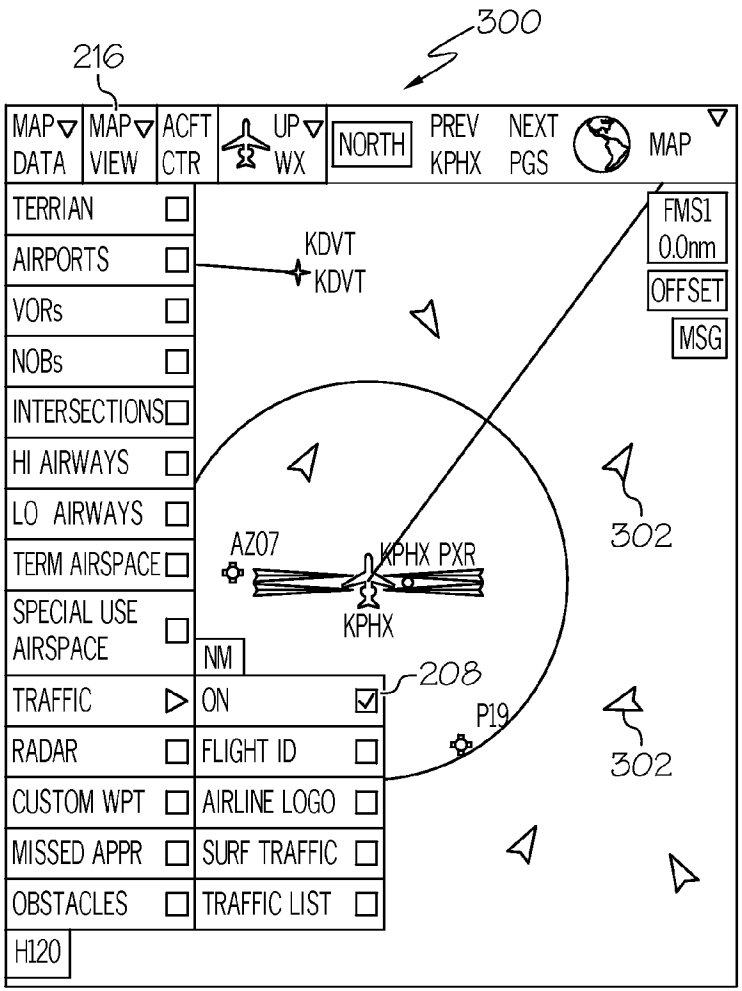
FIGS. 2-7 are exemplary illustrations of graphical displays comprising a menu system for controlling the display of traffic information, particularly Aircraft Symbology, Operating Company Symbology, and Flight ID.

In response to the pilot selecting ON button 208, aircraft symbology 302 within a display radius is graphically rendered on the display, as shown on the exemplary visual display 300 in FIG. 3. The display radius is the rendered geographic area around the host aircraft measured in nautical miles (nm). The pilot may set the display radius by zooming into display a smaller geographic area or zooming out to display a larger geographic area. This may be done by making a touch gesture on a touch screen display or making the appropriate adjustments under "Map View" button 215. However, it should be appreciated that the display radius will be set to a default of approximately 20 nautical miles (nm) and can be adjusted to the desired range as required.

Figure 4:
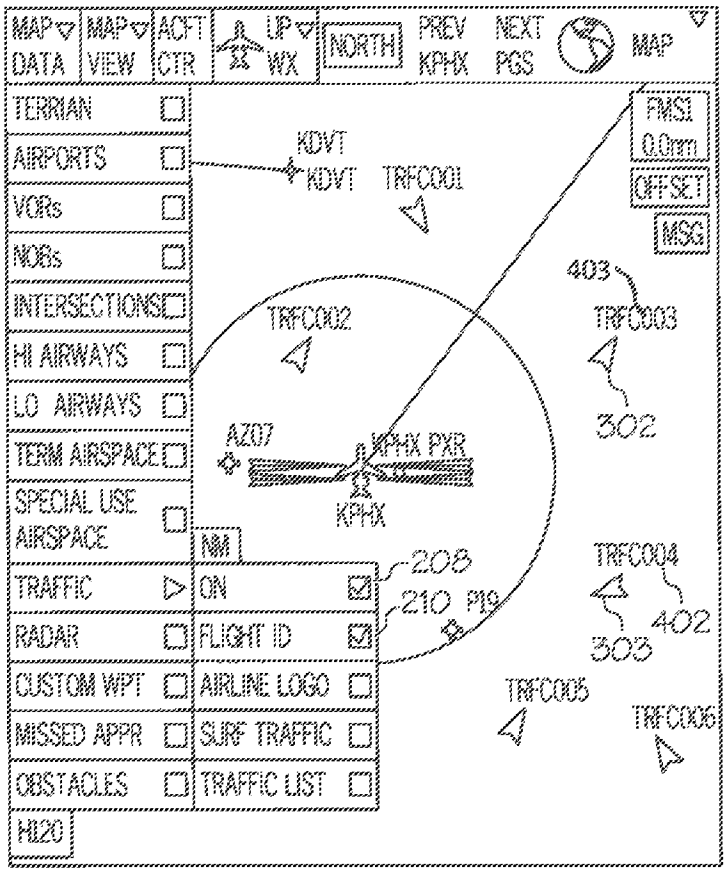

FIG. 4 is an exemplary visual display 400 that illustrates a selection of the FLIGHT ID button 210. As can be seen, selecting the FLIGHT ID button 210 renders identification information 402 and 403 of each aircraft proximate each aircraft symbol 302 and 303, respectively. The identification information is received from the wireless receiver 122 (FIG. 1) and is utilized by the aircraft display system 100 (FIG. 1) to rendered the information 402 and 403 on the display. This information enables the pilot to differentiate between different aircraft symbology. It may then be utilized by the pilot to locate the neighboring aircraft of interest. For example, the pilot is instructed to follow another aircraft to prepare for landing. The pilot may locate the position of the aircraft on the display in order to efficiently determine when the aircraft of interest will be in the pilot's viewable range. This reduces the workload of the pilot during times of high stress, such as takeoff and landings.

Figure 5:
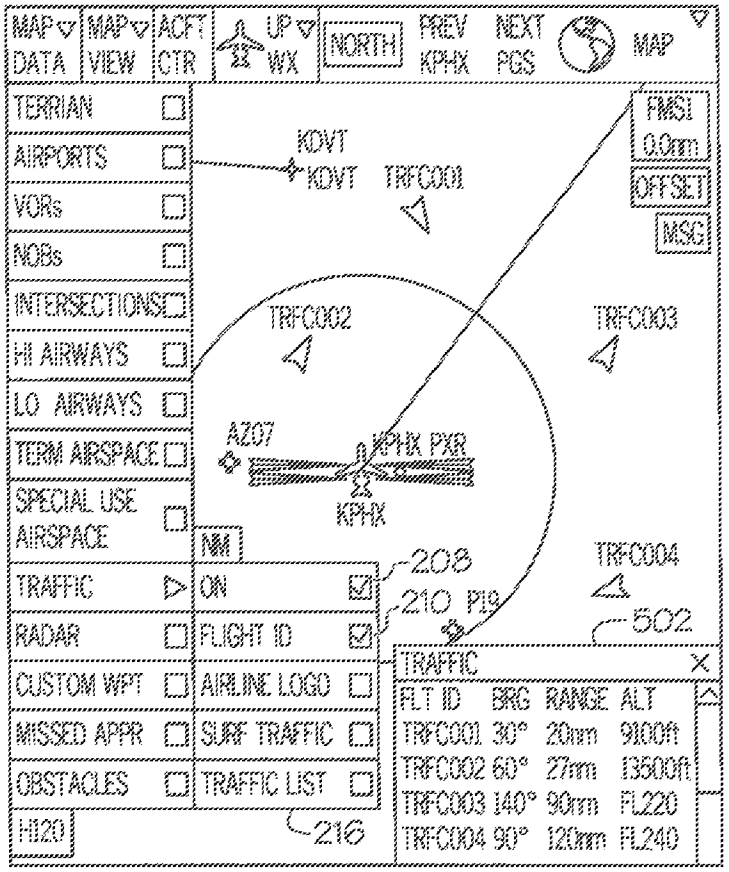

In addition, the pilot may select the TRAFFIC LIST button 216 to display list 502 as shown on the exemplary visual display 500 in FIG. 5. The list 502 shows additional traffic information about each aircraft that is within the display radius. This traffic information includes but is not limited to bearing, range, and altitude. The pilot may utilize the altitude information associated with each aircraft to gain a three-dimensional perspective of the air traffic within the display radius increasing the pilot's situational awareness.

Figure 6:
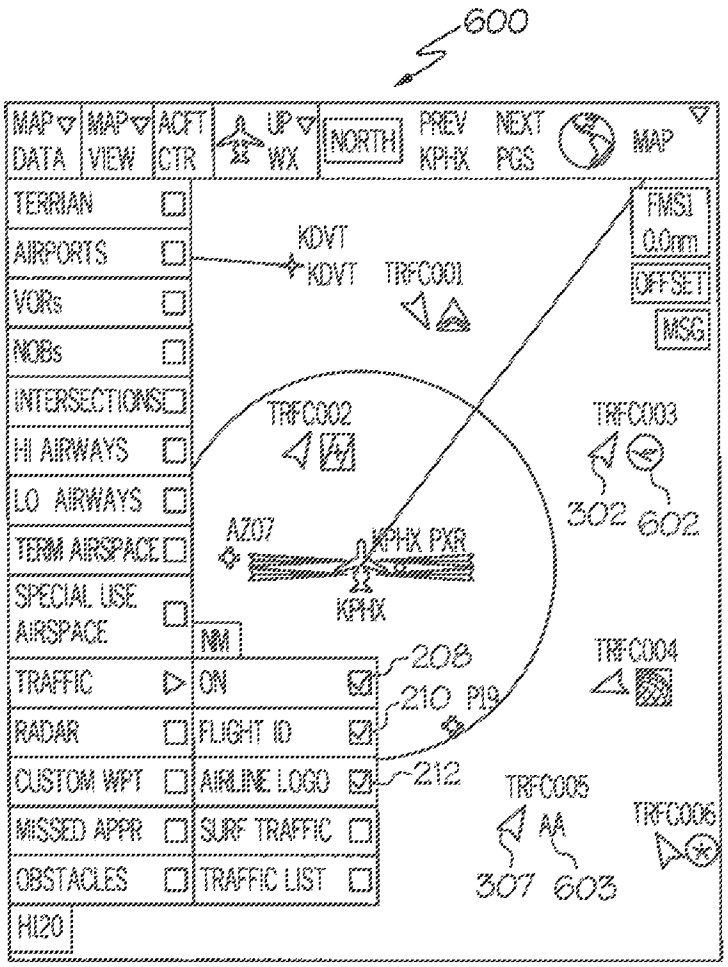

FIG. 6 is an exemplary visual display 600 that illustrates a selection of the FLIGHT ID button 210 and an AIRLINE LOGO 212 button. The additional selection of the AIRLINE LOGO 212 button graphically renders Operating Company Symbology 602 and 603 associated with each aircraft symbology 302 and 307. As discussed above, the Operating Company Symbology 602 may be comprised of the company's logo, their chosen colors (e.g. blue, red, and orange would be utilized to represent Southwest), and/or associated letters or numbers that would distinguish the company from other companies. This assists the pilot to identify the companies that are operating each aircraft, which may be useful when ATC instructs the pilot to perform some command providing only the bearing and name of the operating company.

Figure 7:
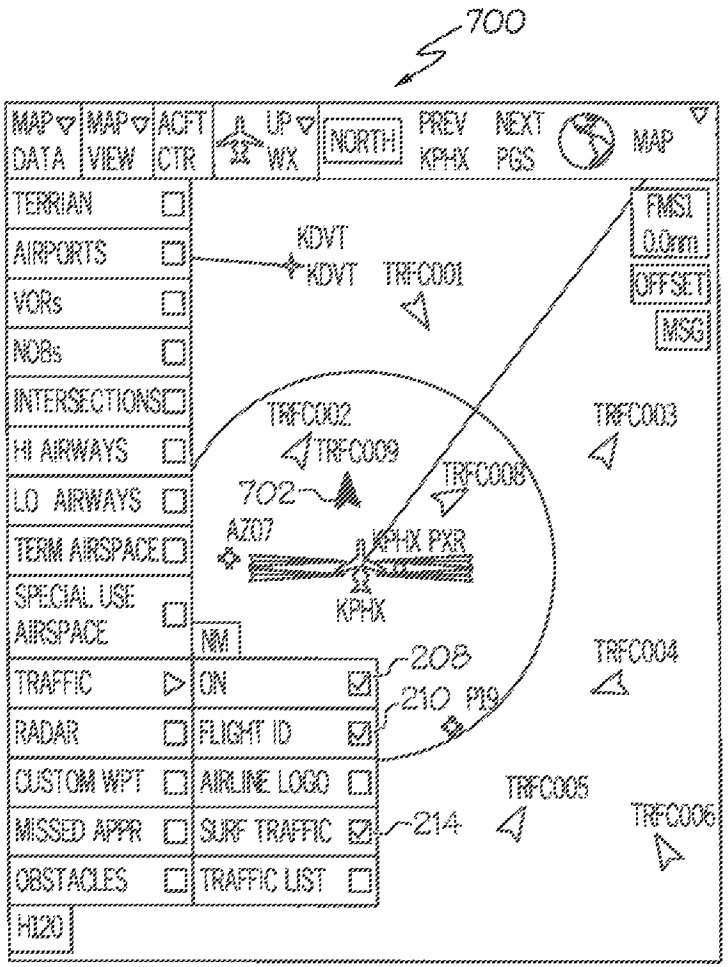

FIG. 7 is an exemplary visual display 700 that illustrates a selection of the FLIGHT ID button 210 and a SURF TRAFFIC button 214. This displays different symbology 702 (e.g. symbologies that represent aircraft that have landed within a predetermined amount of time are represented in a different manner (e.g. filled) than aircraft that are in the air. The length of this predetermined amount of time may be set by the user or system designer. The predetermined time span must be kept small to reduce the number of aircraft symbols that are rendered on the display. This is efficiently done by refreshing the renderings on the display in a prompt manner.

Figure 8:
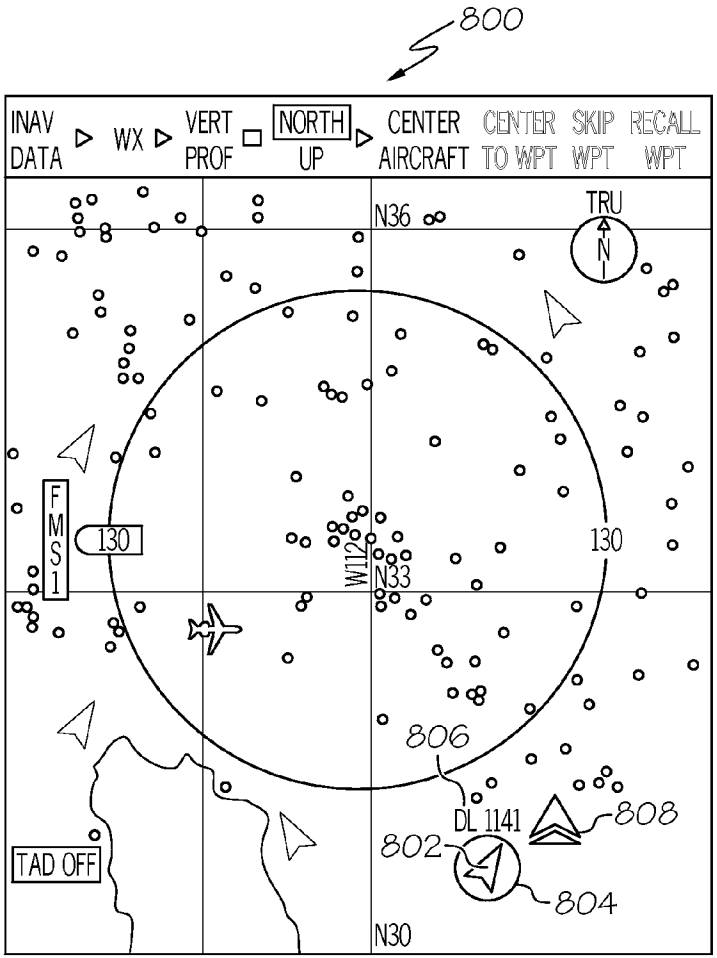
FIG. 8 is an exemplary illustration of a graphic display comprising a selected Aircraft Symbol and its associated traffic information.

FIG. 8 is an exemplary illustration of a graphic display comprising a selected Aircraft Symbol 802 and its associated traffic information 804, 806, and 808. To perform this operation, the user selects the displayed aircraft symbol 802 of interest; e.g. via cursor control, touchscreen, etc. In response to this selection a circle 804 is displayed around the selected aircraft symbol 802. In addition, the Flight ID 806 and Operating Company Symbology 808 are displayed proximate to the selected aircraft symbol.

Figure 9:
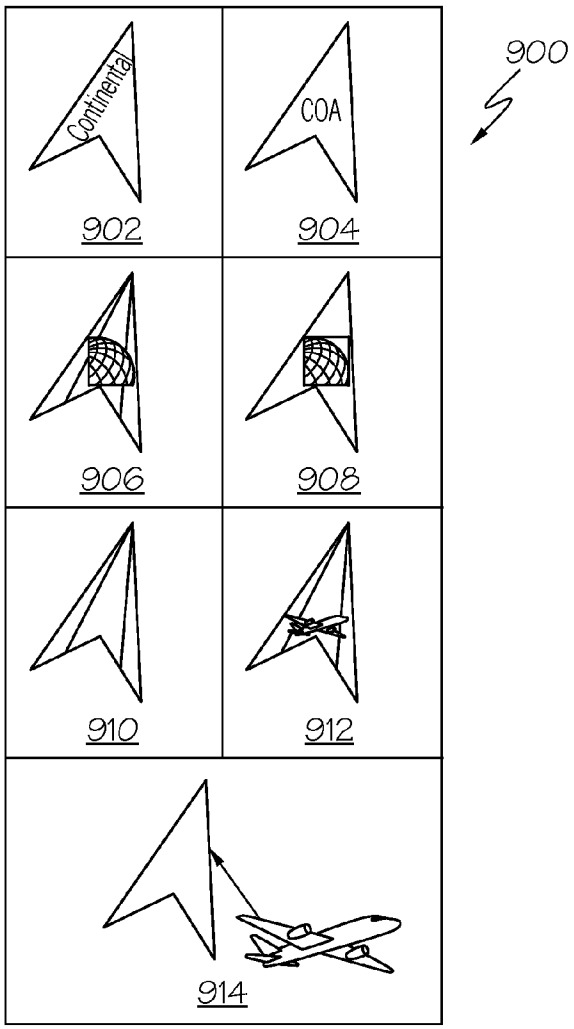
FIG. 9 is an exemplary illustration of a chart comprising various ways of displaying Aircraft Symbol and its associated Operating Company Symbology.

FIG. 9 is an exemplary illustration of a chart comprising various ways of displaying aircraft symbology and their associated Operating Company Symbology. Aircraft symbols 902 and 904 illustrate two ways of differentiating between aircraft symbology by displaying the operating company name 902 and call sign 904 inside the aircraft symbology. An alternative method of displaying is shown in 906 where the aircraft symbol is filled in with the representative airline color or colors, while in symbol 908 the background of the aircraft symbology may be opaque. Symbols 910 and 912 illustrate how an aircraft may be illustrated if the representative airline colors are comprised of three colors. Alternatively, symbol 914 displays how an arrow may be used to illustrate the association between the Operating Company Symbology and the aircraft symbology. It should be appreciated that each illustrations of the aircraft symbology and the Operating Company Symbology are merely exemplary.

Figure 10:
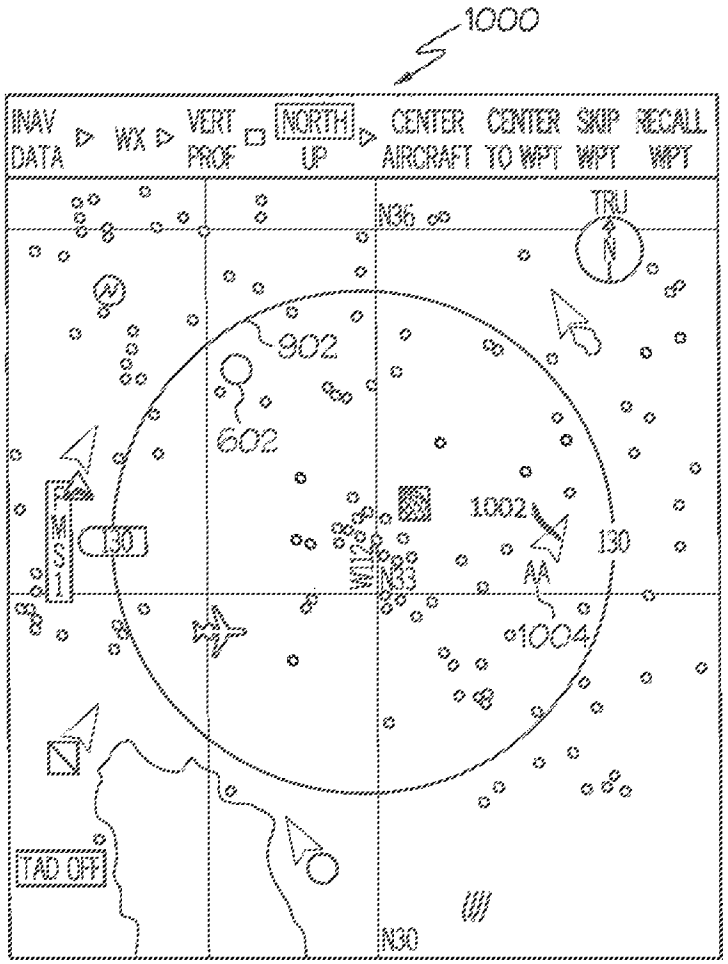
FIGS. 10 and 11 are exemplary illustrations of graphical displays comprising Aircraft Symbology and their associated Operating Company Symbology.
Figure 11:
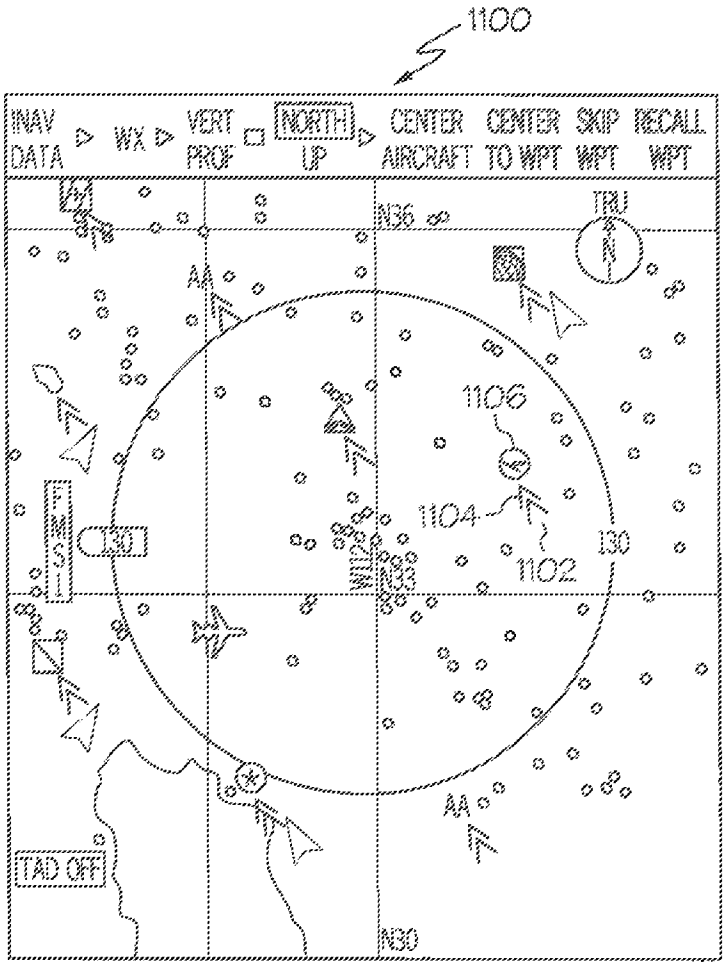

FIGS. 10 and 11 are exemplary illustrations of graphical displays comprising aircraft symbology 1002 and 1102 and their associated Operating Company Symbology 1004 and 1104, respectively. As can be seen, FIG. 10 and FIG. 11 illustrate different methods of how to show the aircraft symbology is associated with the Operating Company Symbology. This is done by either placing the Operating Company Symbology 1004 proximate to the aircraft symbol 1002 as shown in FIG. 10. Alternately, various types of arrows may be used to indicate their associations 1004 as shown in FIG. 11. Also, in each of these figures a terrain map has been render on the display instead of the blank background that was shown in FIGS. 2-7. The terrain map may help the pilot locate points of interest or visual reference points, to help orientate the pilot. As can been seen, the menu 202 and traffic menu 216 has been removed from the display. This is done by clicking with a non-touch screen user interface or touching the screen with a touch screen user interface on any other part of the screen that does not contain the menu 202 or traffic menu 216. The ability to show and hide these menus allows the pilot to change the traffic information that is displayed, while no continuously obstructing a large percentage of the screen. It should be appreciated that the menu 202 may be placed in any location on the screen to help ensure that the least amount of screen data is obstructed by the pilot in making the necessary selections.

Figure 12:
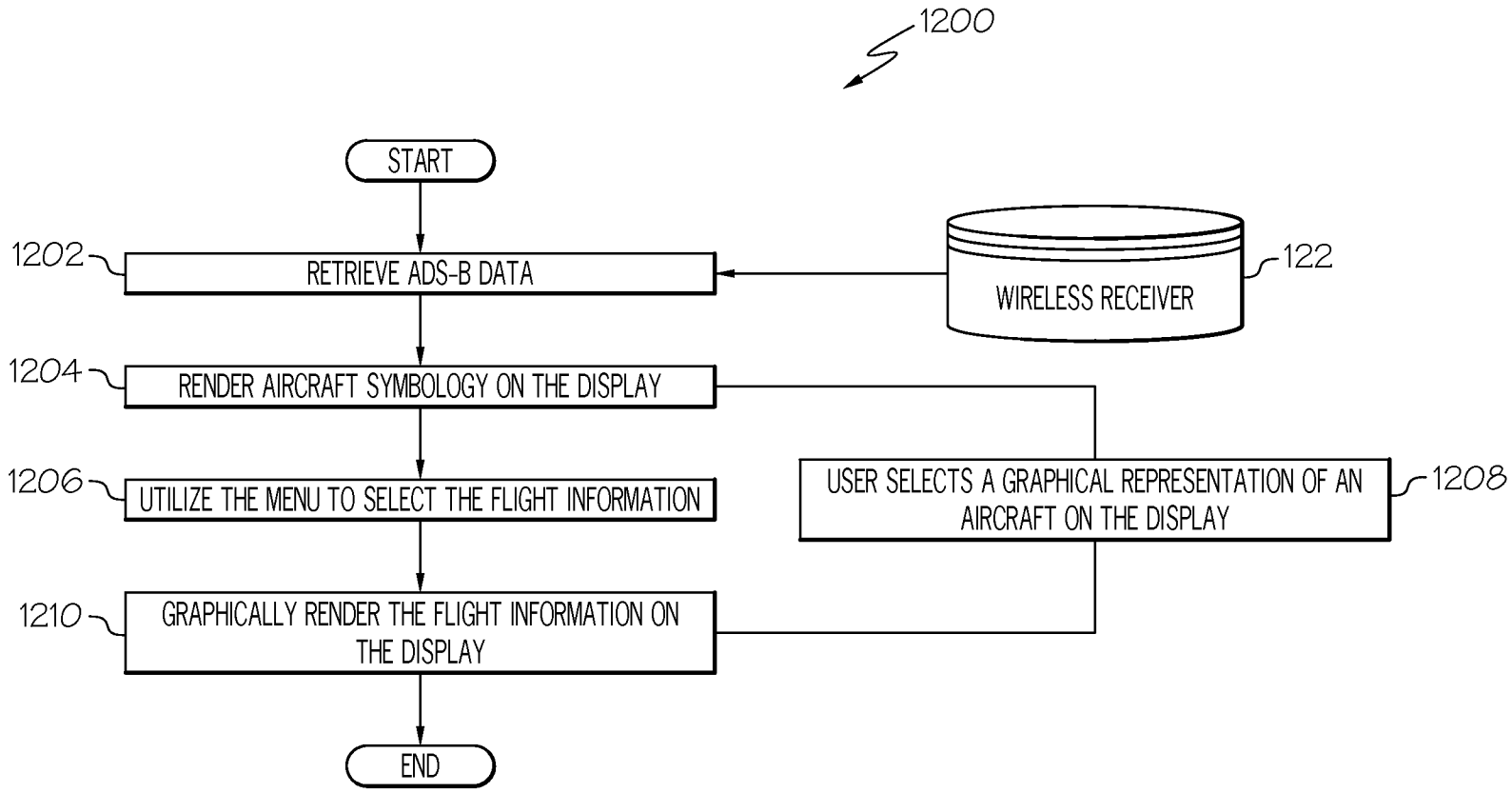
FIG. 12 is a flowchart for graphically displaying symbology representative of traffic information in accordance with an exemplary embodiment.

FIG. 12 is a flowchart 1200 of a method for graphically displaying symbology in accordance with an exemplary embodiment. In STEP 1202, the traffic information module 105 receives ADS-B data from the wireless receiver 112. This data then is used to render the aircraft symbology on the display (STEP 1204). The pilot may then utilize menu 208 to choose the associated traffic information type to be rendered on the on the display (STEP 1206). Alternatively, the pilot may select a graphical representation of an aircraft on the display (STEP 1208). In STEP 1210, the traffic information for either the individual aircraft (STEP 1208) or all aircraft within the display radius (STEP 1206) are graphically rendered on the display. This process is then repeated anytime the pilot wants to alter the data on the display.

Thus, there has been provided a novel system and method for displaying graphically displaying aircraft traffic information that includes the Flight ID, Operating Company, and Surface Traffic. This may allow the pilot to efficiently locate other aircraft and minimize the risk of landing or takeoff related aviation incidents.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for graphically displaying traffic information on an aircraft display, the method comprising:

receiving aircraft information;

rendering aircraft symbology that is graphically representative of at least one aircraft;

rendering a menu system with a plurality of aircraft information options comprising Flight ID, Operating Company, and Surface Traffic;

receiving a user selection of at least one of the aircraft information options; and rendering, in response to the user selection, a graphical representation of the selected aircraft information in association with the aircraft symbology.

2. The method of claim 1 further comprising setting the boundaries of the display radius to a predefined distance selected by the user.

3. The method of claim 1 further comprising displaying Operating Company Symbology proximate to the aircraft symbology in response to a selection of the Operating Company information.

4. The method of claim 3 wherein displaying the Operating Company Symbology comprises displaying the logo of the operating company.

5. The method of claim 4 wherein the aircraft symbology is visually associated with the logo of the operating company by displaying an arrow from the aircraft symbology to the logo.

6. The method of claim 1 further comprising displaying the Operating Company Symbology within the aircraft symbology in response to a selection of the Operating Company information option.

7. The method of claim 6 wherein the Operating Company Symbology comprises representative colors of the operating company.

8. The method of claim 1 further comprising displaying aircraft symbology in an alternative format to illustrate that the aircraft has landed within a predetermined time, in response to a user selecting the Surface Traffic information option.

9. The method of claim 1 further comprising displaying a list of the flight ID, bearing, range, and altitude for the displayed aircraft symbology.

10. A method for graphically displaying traffic information associated with an aircraft, the method comprising:

receiving traffic information;

rendering aircraft symbology that is graphically representative of at least one aircraft within a display radius;

receiving a user selection of an aircraft symbol; and rendering graphical representations of a Flight ID and Operating Company Symbology associated with the selected aircraft symbology proximate to the selected aircraft.

11. The method of claim 10 wherein displaying Operating Company Symbology comprises displaying a logo of the operating company.

12. The method of claim 11 wherein the aircraft symbology is visually associated with the logo of the operating company by displaying an arrow from the aircraft symbology to the logo.

13. The method of claim 10 further comprising displaying the Operating Company Symbology within the selected aircraft symbol.

14. The method of claim 13 wherein the Operating Company Symbology comprises the representative colors of the operating company.

15. The method of claim 10 further comprising displaying a list of the Flight ID, bearing, range, and altitude for the displayed aircraft symbology.

16. A system for graphically displaying traffic information on a display, comprising:

a source of aircraft information;

an avionics display;

a user input device;

an Operating Company Symbology database; and a processor coupled to the avionics display, source of aircraft information, and the user input device, and configured to (1) receive traffic information; (2) determine the Operating Company Symbology from the received aircraft information; (3) render a menu system with a plurality of information options comprising Flight ID, Operating Company, and Surface Traffic; and (4) in response to user input, graphically render aircraft symbology and the associated Operating Company Symbology on the display.

17. The system of claim 16 wherein the processor is further configured to graphically generate a logo of the operating company and render it on the display proximate to the aircraft symbology.

18. The system of claim 16 wherein the processor is further configured to generate colors of the operating company and render them on the display within the aircraft symbology.

19. The system of claim 16 wherein the processor is further configured to display a list of the Flight ID, Bearing, Range, and Altitude for the displayed aircraft symbology.

* * * * *